United States Patent [19]

Yonahara

[11] 4,388,982

[45] Jun. 21, 1983

[54] FOOTHOLD DEVICE

[76] Inventor: Yoshihiro Yonahara, 255-4, Oaza Iida, Omiya-Shi, Saitama, 330, Japan

[21] Appl. No.: 202,442

[22] PCT Filed: Dec. 12, 1979

[86] PCT No.: PCT/JP79/00315

§ 371 Date: Jul. 9, 1980

§ 102(e) Date: Jul. 9, 1980

[87] PCT Pub. No.: WO80/01298

PCT Pub. Date: Jun. 26, 1980

[30] Foreign Application Priority Data

Dec. 12, 1978 [JP] Japan ..... 53-171277

[51] Int. Cl.[3] ..... E04G 3/10; B63B 9/06

[52] U.S. Cl. ..... 182/82; 182/130; 182/150; 182/115

[58] Field of Search ..... 182/82, 150, 142, 83, 182/115, 130; 108/149

[56] References Cited

U.S. PATENT DOCUMENTS

| | | | |
|---|---|---|---|
| 1,484,480 | 2/1924 | Donaggio | 182/150 |
| 1,683,138 | 9/1928 | Kautz | 182/199 |
| 2,223,980 | 12/1940 | Zent | 182/197 |
| 2,556,105 | 6/1951 | Rhett | 182/199 |
| 3,375,900 | 4/1968 | Conley | 182/150 |
| 4,068,738 | 1/1978 | Reed | 182/150 |
| 4,121,822 | 10/1978 | DiSabatino | 182/3 |
| 4,253,549 | 3/1981 | Petren | 182/150 |

FOREIGN PATENT DOCUMENTS

| | | | |
|---|---|---|---|
| 475670 | 3/1915 | France | 108/149 |

*Primary Examiner*—R. P. Machado

[57] ABSTRACT

A scaffold having a number of platform plates connected through independent chains. Independent chains are also provided above the uppermost platform and below the lowermost platform for connection to upper fitting members and lower fitting members, respectively integral with a wall. The latter chains are provided with tensioning means enabling the scaffold to be firmly and rigidly secured to the wall. The platforms are also adjustable horizontally.

2 Claims, 7 Drawing Figures

2a
4a
5a
6
12
6
12
10
9a
18
17
16
8a
13
22
20a
25
24
7a
21a
22
7
4b
3a
5a
6
16
6
17
18
9b
12
12'
22
8b
11
21b
25
24
1
20b
7b
7c
7d
30a
6
31a
2b
31b
6
6
30b
3b 2a
4a
5a
6
6
18
17
16
33a
3a
4b
5a
6
6
32a
7
16
18
33b
22
21a
17
20a
25
32b
22
21b
22
24
1
24
25
7a
24
34
20b
34
7b

FOOTHOLD DEVICE

TECHNICAL FIELD

This invention relates to a foothold device which is to be provided on such vertical wall surface as of a high building and is characterized in that foothold plates are connected with each other through chains, therefore can be transported and housed as stacked as they are, are easy to set, do not twist the chains and are easy to horizontally set.

BACKGROUND TECHNIQUE

There is already a method of forming a foothold to be provided on such vertical wall surface as of a high building wherein framework members are stacked in turn on the ground surface or wherein embedded pieces called inserts are provided in advance in concrete for a building or in prefabricated units and are used.

The first method, that is, the method of forming a foothold by stacking framework members on the ground surface along the wall surface of a building shall be described first. It has defects that many framework members are required for a high building, troubles are required for the assembling work, much labor and time are required for the disassembly and transportation in moving the field and further, as the members are stacked from below in the assembling work, there is a danger that the framework may fall.

The second method, that is, the method of forming a foothold by providing embedded pieces in concrete for a building or in prefabricated units and utilizing them shall be described now. It has defects that embedded pieces called inserts must be provided in advance in concrete units or prefabricated units, troubles are required to make the foothold, the cost is high and further an aftertreatment must be made by fitting plugs into the exposed part of the wall surface after the work is completed. According to the present invention, foothold plates are connected with each other through independent chains so as to be easy to carry, house and set, to prevent the chains from being twisted, to be easy to horizontally set and to make the foothold setting work safe.

DISCLOSURE OF THE INVENTION

The present invention relates to a foothold device to be suspended from above wherein foothold plates are connected with each other through independent chains substantially in four corners and further respective independent chains are connected above the uppermost foothold plate and below the lowermost foothold plate and are connected and fixed to fitting members provided in the upper and lower parts of the wall surface.

BEST FORM TO WORK THE INVENTION

The present invention shall be described in detail in the following with reference to the accompanying drawings.

Figure 1:
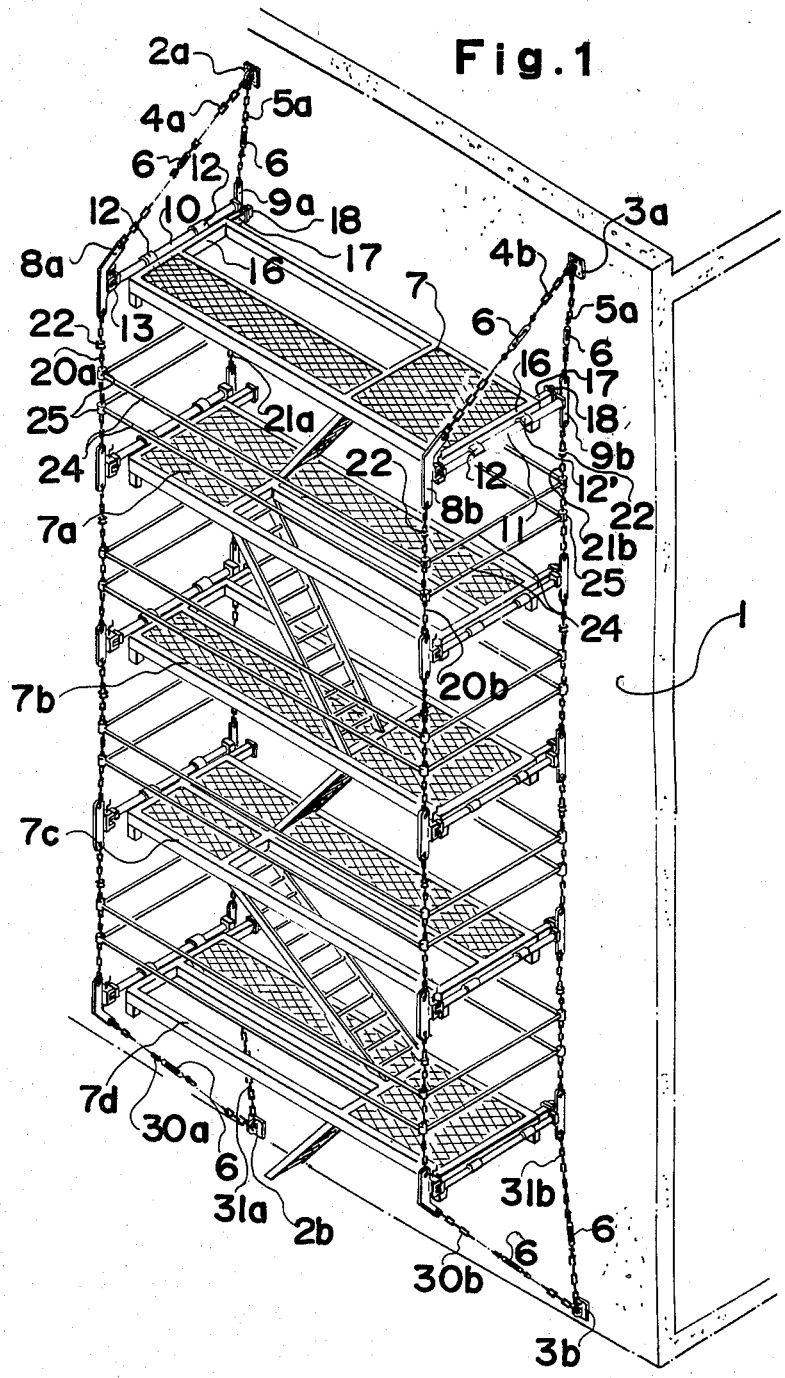
FIG. 1 is a perspective view of a device according to the present invention.

In FIG. 1 showing a perspective view of a device according to the present invention, reference number 1 denotes a wall surface of a high building and fitting members 2*a*, 2*b* and 3*a*, 3*b* are fitted at a predetermined width in the lateral direction to the upper and lower parts of the wall surface 1. Needless to say, independent chains 4*a*, 4*b* and 5*a*, 5*b* are fitted respectively to the above mentioned fitting members 2*a*, 3*a*. Length adjusting members or concretely turnbuckles 6 are provided respectively in proper positions of the chains 4*a*, 4*b* and 5*a*, 5*b*. Needless to say, instead of the fitting members 2*a*, 3*a*, such fitting members as rails may be parallelly projected from the roof and foothold plates may be suspended from them. Then, chain fitting pieces 8*a*, 8*b* and 9*a*, 9*b* are connected respectively to the lower ends of the above mentioned chains 4*a*, 4*b* and 5*a*, 5*b*.

In FIG. 1, the above mentioned chain fitting pieces 8*a*, 8*b* and 9*a*, 9*b* are not directly fitted respectively substantially to the four corners of a foothold plate 7 but a supporting rod 10 is provided between the chain fitting pieces 8*a* and 9*a*, a supporting rod 11 is provided between the chain fitting pieces 8*b* and 9*b* and the foothold plate 7 is provided between the supporting rods 10 and 11.

That is to say, hooks 12 engaging respectively with the above mentioned supporting rods 10 and 11 are provided respectively on both sides at both ends of the foothold plate 7 in advance and are engaged with the supporting rods 10 and 11. Therefore, the foothold plate 7 can be removed from other parts in order to be carried or housed.

Figures 2, 5, 6:
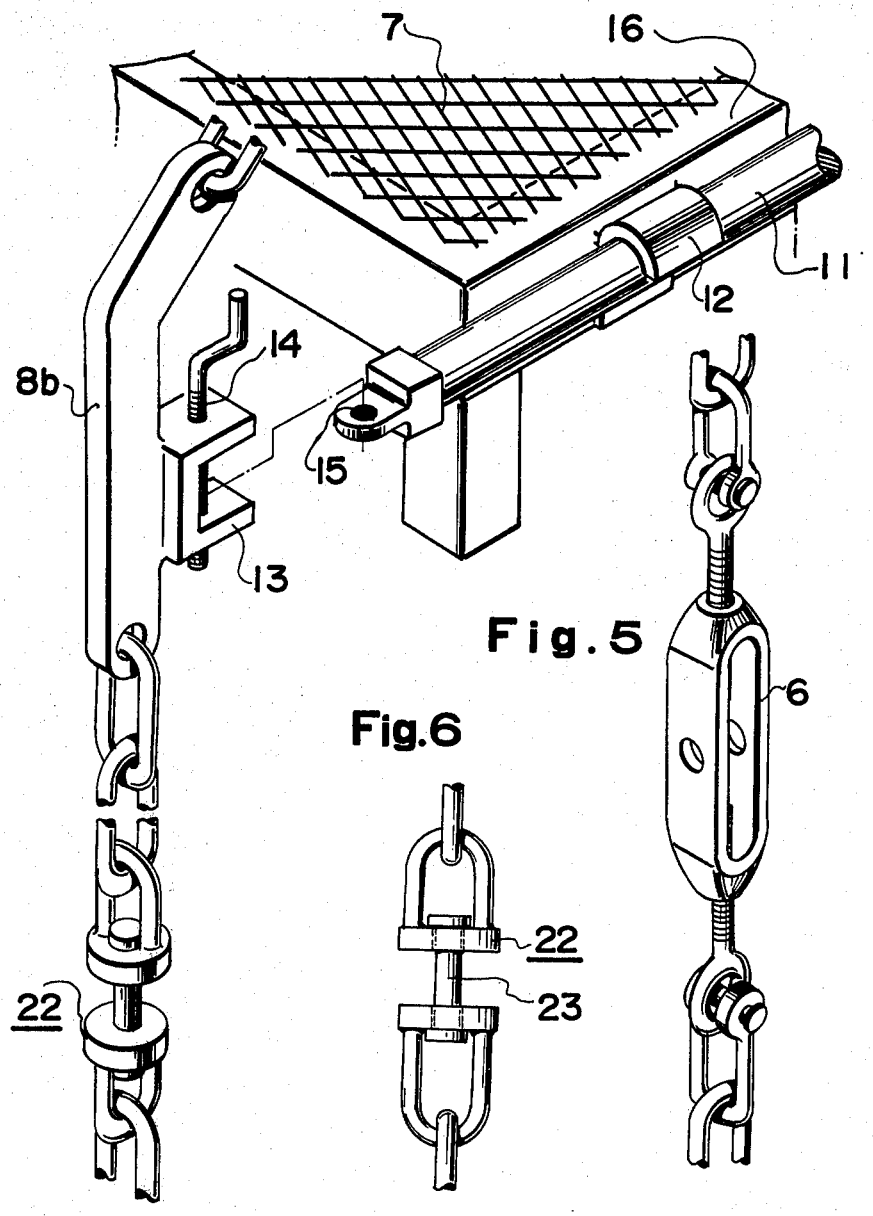
FIG. 2 is a perspective view of a chain fitting part.
FIG. 5 is a perspective view of a length adjusting part.
FIG. 6 is a perspective view of a twist preventing member part.

Further, the chain fitting pieces 8*a* and 8*b* located outside in FIG. 1 are respectively formed as shown in FIG. 2 so that the horizontal degree of the foothold plate 7 can be adjusted. Needless to say, the chain fitting pieces 9*a*, 9*b* may be also formed the same.

That is to say, to explain the chain fitting piece 8*b* for example, a channeled bracket 13 is welded to the chain fitting piece 8 and a male screw rod 14 bent in the upper portion to form a handle is screwed between the upper and lower pieces of the bracket and is screwed with a female screw hole 15 formed in the end portion of the above mentioned supporting rod 11.

Therefore, when the male screw rod 14 is rotated, for example, the supporting rod 11 will be moved up and down at one end and, even if the wall surface is curved more or less, the foothold plate will be able to be fitted horizontally. Now, to explain the foothold plate 7, frame members 16 at both ends are formed to be hollow and distance adjusting members 17 are respectively inserted into them.

That is to say, the distance adjusting member 17 is to adjust the distance between the wall surface 1 of the high building and the foothold plate 7 and is fitted at the tip with such friction member 18 as of rubber. A fixing screw 19 is screwed in a proper position of the frame member 16 at each end of the foothold plate 7.

Therefore, when the fixing screw 19 is loosened, the distance adjusting member 17 is moved in or out and the fixing screw 19 is fastened in a required position, the fixing screw 19 will be pressed at the tip against the distance adjusting member 17 and a predetermined distance will be able to be obtained.

By the way, after a temporary distance adjustment, the device of the present invention is suspended and the above mentioned distance adjustment can be made while sitting on the foothold 7 and pressing the wall surface 1 of the high building with the feet.

Then, foothold plates 7*a*, 7*b*, 7*c*, 7*d*,—are suspended respectively substantially in the four corners at proper intervals below the above mentioned foothold 7.

They are fitted in turn respectively with independent chains 20*a*, 20*b* and 21*a*, 21*b* below the above mentioned chain fitting pieces 8*a*, 8*b* and 9*a*, 9*b* and are provided the same as the above mentioned foothold plate 7. Needless to say, in the present invention, twist preventing members 22 are provided respectively in proper positions of the chains 20*a*, 20*b* and 21*a*, 21*b*.

They are formed, for example, as shown in FIG. 6. That is to say, the respective chains 20*a*, 20*b* and 21*a*, 21*b* may be connected between them in proper positions respectively through bolt-shaped pieces 23 so as to be quite free above and below. Further, the chains 20*a*, 20*b* and 21*a*, 21*b* are provided with handrails 24.

Figure 3:
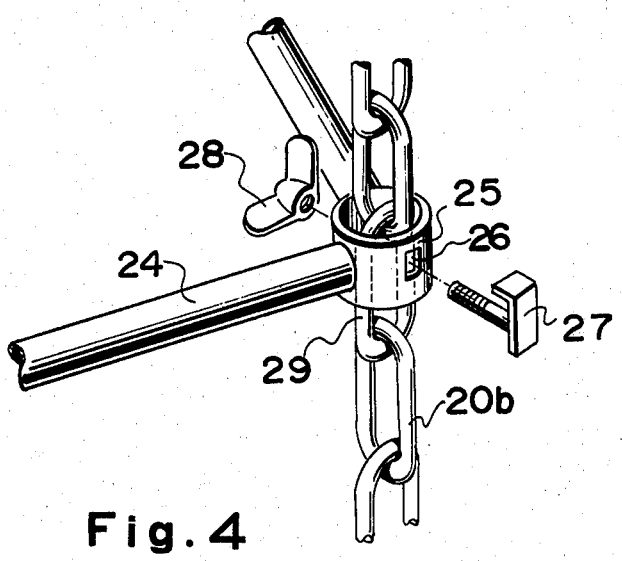
FIG. 3 is a disassembled perspective view of a handrail fitting part.
Figure 4:
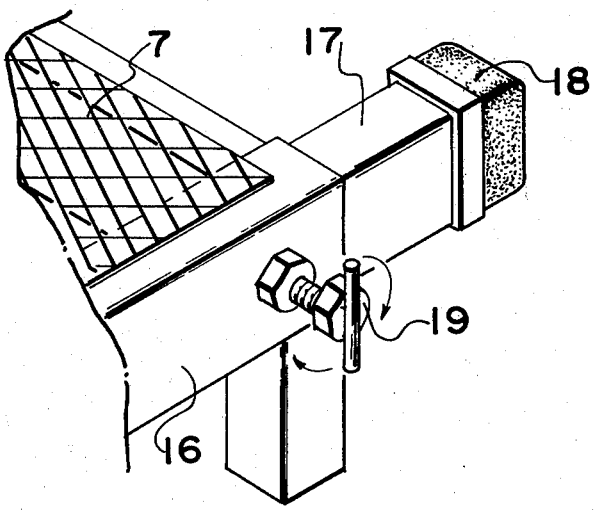
FIG. 4 is a perspective view of a distance adjusting member part.

In the present invention, the handrails are formed, in advance, of pipes or the like so as to be substantially of the same size as of the foothold plates 7, 7*a*, 7*b*,—and are provided respectively in the corners with chain inserting rings 25. As shown in FIG. 3, through holes 26 are provided respectively in the opposed positions of the chain inserting rings 25, bolts 27 and nuts 28 are separately prepared and the bolt 27 is inserted through the through holes 26 of the chain inserting ring to pass through a ring 29 forming the chain and has the nut 28 screwed on the other side so as to be fixed.

Lastly, below the lowermost foothold plate 7*d*, the independent chains 20*a*, 30*b* and 31*a*, 31*b* are fitted respectively to the above mentioned fitting members 2*b* and 3*b*.

That is to say, the length adjusting members or concretely turnbuckles 6 are provided respectively the same as the above mentioned chains 4*a*, 4*b* and 5*a*, 5*b* in proper positions of the above mentioned chains 30*a*, 30*b* and 31*a*, 31*b* but are used finally to tension the respective chains suspending the foothold plates 7, 7*a*, 7*b*, 7*c* and 7*d* and to stabilize the foothold plates 7, 7*a*, 7*b*, 7*c* and 7*d* rather than to adjust the length.

Figure 7:
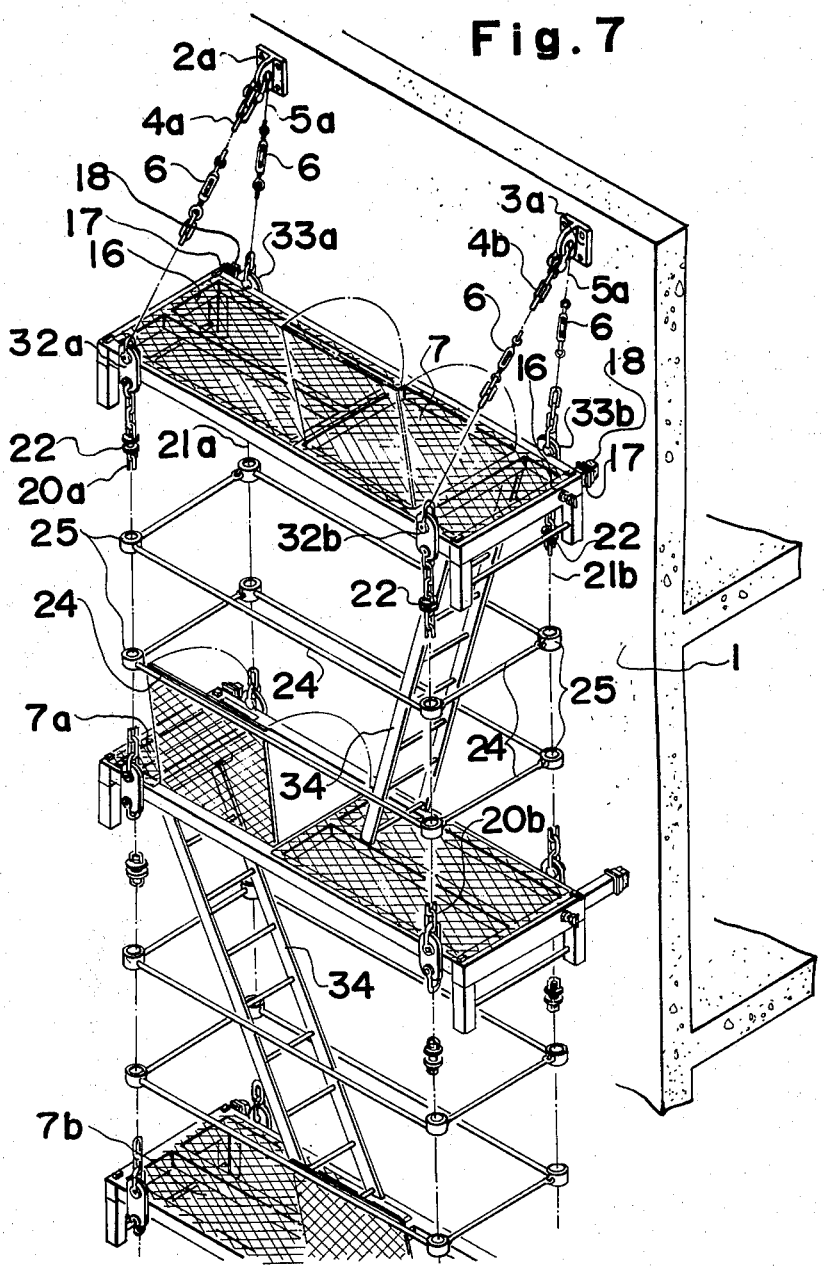
FIG. 7 is a perspective view of a device according to the present invention showing another embodiment.

Another embodiment of the present invention is shown in FIG. 7. This embodiment is more fundamental than the above mentioned embodiment. In this embodiment, the chain fitting pieces 8*a* and 8*b* whereby the horizontal degree can be adjusted are not used and further the supporting rods 10 and 11 are not provided as in the above mentioned embodiment but chain fitting pieces 32*a*, 32*b* and 33*a*, 33*b* are fitted directly to the foothold plates 7 and the other formations are the same as in the above mentioned embodiment.

By the way, in the drawing, reference numeral 34 denotes a ladder connecting between the foothold plates. In setting the device of the present invention, a required number of foothold plates may be connected through the chains 20*a*, 20*b* and 21*a*, 21*b* in advance on the ground and the chains 4*a*, 4*b* and 5*a*, 5*b* of the uppermost foothold plate 7 may be pulled up and may be connected respectively to the upper fitting members 2*a* and 3*a*. In such case, the uppermost foothold plate 7 will incline depending on the projection of the distance adjusting member 17 but will be able to be easily made horizontal by the turnbuckles 6 provided respectively on the above mentioned chains 4*a*, 4*b* and 5*a*, 5*b* and by the male screw rods 14 in the embodiment in FIG. 1. As a result, the lower footholds 7*a*, 7*b*, 7*c* and 7*d* will also necessarily become horizontal.

Lastly, the chains 30*a*, 30*b* and 31*a*, 31*b* of the lowermost foothold plate 7*d* may be connected respectively to the lower fitting members 2*b* and 3*b* and the turnbuckles 6 may be tightened to stabilize the entirety.

Utilizability in the Industry

As in the above, the foothold device of the present invention may be only suspended from above, is easy to set, is easy to handle to carry and house and is most adapted as a foothold device for high buildings. Its utilizability in the industry is very high.

I claim:

1. The scaffold for attachment to a building wall or the like having two pair of attachment fittings spaced laterally from each other, each pair of attachment fittings having an upper member and a lower member spaced vertical from each other, comprising two pair of chains, the chains of each pair being securable to the upper and lower members of an associated pair of fittings, a plurality of platforms located between the respective chains of each pair in vertically spaced intervals, means for attaching each of said platforms to each of said chains comprising a bracket located on each chain at a position corresponding to the interval of said platform, a rod extending between the corresponding brackets of each pair of chains, and hook means located along the side edges of said platform and engaging over said rods, the brackets located on the corresponding chain of each pair of chains being provided with means for adjusting the horizontal level of said rod to thereby adjust the level of said platform and means for adjusting the length of said chains located in that portion of each of said chains above the uppermost platform and below the lower most platform whereby on securing said chains to said fitting said chains may be placed under tension forming a rigid scaffold secured to said wall.

2. The scaffold according to claim 1 wherein said at least one rod is provided with an adjustable extension selectively positionable against said wall.

* * * * *